US005959523A

United States Patent [19]

Westberg

[11] Patent Number: 5,959,523

[45] Date of Patent: Sep. 28, 1999

[54] MAGNETIC CORE STRUCTURE

[75] Inventor: Johan Westberg, Ludvika, Sweden

[73] Assignee: ABB Power T&D Company Inc., Raleigh, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/730,201

[22] Filed: Oct. 15, 1996

[51] Int. Cl.[6] ..... H01F 27/24

[52] U.S. Cl. ..... 336/234; 336/233; 336/216; 336/217

[58] Field of Search ..... 336/233, 234, 336/216, 217

[56] References Cited

U.S. PATENT DOCUMENTS

| | | | |
|---|---|---|---|
| 3,153,215 | 10/1964 | Burkhardt et al. | 336/217 |
| 3,157,850 | 11/1964 | Winter et al. | 366/216 |
| 3,283,281 | 11/1966 | Stein et al. | 336/217 |
| 3,477,053 | 11/1969 | Burkhardt et al. | 366/217 |
| 3,509,507 | 4/1970 | Specht | 336/12 |
| 4,100,521 | 7/1978 | Hori | 336/100 |
| 4,200,854 | 4/1980 | DeLaurentis et al. | 336/217 |
| 4,201,966 | 5/1980 | DeLaurentis | 336/217 |
| 4,283,842 | 8/1981 | DeLaurentis | 29/606 |
| 4,327,349 | 4/1982 | Ettinger et al. | 336/234 |
| 4,424,503 | 1/1984 | Kashima | 336/217 |
| 4,482,880 | 11/1984 | Ohta et al. | 336/217 |
| 4,488,136 | 12/1984 | Hansen | 336/215 |
| 4,520,556 | 6/1985 | Pasko, Jr. et al. | 29/606 |
| 4,521,957 | 6/1985 | McLeod | 29/609 |
| 4,893,401 | 1/1990 | Viani | 29/738 |
| 4,918,832 | 4/1990 | Tokumasu et al. | 29/606 |

FOREIGN PATENT DOCUMENTS

| | | | |
|---|---|---|---|
| 25 45 461 | 4/1977 | Germany . | |
| 58-0066316 | 4/1983 | Japan . | |
| 58-66316 | 4/1983 | Japan | 336/216 |
| 60-158609 | 8/1985 | Japan | 336/217 |
| 62-26805 | 2/1987 | Japan | 336/234 |

*Primary Examiner*—Michael L. Gellner
*Assistant Examiner*—Anh Mai
*Attorney, Agent, or Firm*—Woodcock Washburn Kurtz Mackiewicz & Norris LLP

[57] ABSTRACT

Magnetic core structure of the stacked type having outer legs, at least one inner leg, and top and bottom yokes formed of a plurality of stacked groups of layers of metallic laminations. The yoke and leg laminations have their ends cut diagonally to provide a closed magnetic circuit having diagonal joints between adjoining ends of the yoke and leg laminations. The length dimensions of the inner leg laminations are uniform from layer to layer within each group, while the junction of the diagonally cut ends of the inner leg laminations are offset from the centerline thereof from layer to layer in a step pattern that progresses an equal number of steps on each side of the centerline of each group of layers of inner leg laminations to be step dependent. The configuration of the outer leg laminations and the top and bottom yoke laminations are uniform from layer to layer within each group to be step independent. A method of stacking the laminations in groups is disclosed and there is also disclosed a method of making the center or inner laminations of the magnetic core structure in two parts where the width of the laminations is greater than the commercially available lamination material.

10 Claims, 7 Drawing Sheets

MAGNETIC CORE STRUCTURE

BACKGROUND OF THE INVENTION

1. Field of the Invention

This invention relates, in general to magnetic core structures for electrical inductive apparatus, such as transformers, and more specifically, to magnetic core structures of the stacked type.

2. Description of the Prior Art

One example of a prior art magnetic core structure of the stacked type is disclosed in U.S. Pat. No. 3,153,215. That patent discloses magnetic core structures of the stacked type which have step lap joints between the mitered ends of the limb or leg and yoke portions of the magnetic core. In a step lap joint, the joints between the mitered or diagonally cut ends of the leg and yoke laminations, in each layer of the lamination, are incrementally offset from similarly located joints in adjacent layers in a predetermined step or progressive pattern, with the joints being stepped at least three times in one direction before the direction is changed or the pattern repeated. Magnetic cores with step lap joints have been found to substantially improve the performance of the magnetic core, compared to magnetic cores which utilize conventional butt-lap type joints by lowering the core losses, lowering the exciting volt-ampere requirements, and lowering the sound level of the magnetic core. Other prior art step lap joint arrangements are shown in U.S. Pat. Nos. 3,153,215; 3,477,053; 3,504,318 and 3,540,120. These patents disclose joint arrangements where the desired stepped relationship is obtained between diagonally cut ends of the laminations by providing laminations for each leg or yoke portion which have the same longitudinal dimensions between the diagonally cut ends. The stepped relationship is achieved by incrementally offsetting the mid-points of the laminations of any stacked group of laminations.

In prior art magnetic cores having stepped-lap joints, the stepped-lap joint between the inner leg and the top and bottom yoke laminations is constructed by forming a V-shaped notch in each of the top and bottom yoke laminations. The V-shaped notch in the yoke laminations is incrementally shifted, from layer to layer, parallel to the longitudinal axis of the magnetic core such that the inner leg laminations, which are of equal length, are also incrementally shifted parallel to the longitudinal axis or length of the magnetic core. In this manner, the equal length laminations of the top and bottom yokes are horizontally shifted from layer to layer which uniformly distributes the stepped-lap joint between the leg and yoke laminations and results in a symmetrical core structure which provides superior electrical characteristics. However, there is an inherent difficulty in constructing a horizontal stepped-lap magnetic core due to the multiple spaced end points of the inner leg laminations which are hidden from the view of the operator during assembly of the core thereby necessitating longer assembly times.

Arrangements for stepping the inner leg laminations in a vertical direction are shown in U.S. Pat. Nos. 3,153,215; and 3,743,991. In this type of magnetic core structure, the equal length inner leg laminations are vertically distributed, parallel to the straight side of the inner leg, by progressively notching one yoke lamination deeper and the other yoke lamination shallower than that of adjoining layers. Alternately, the length of the inner length laminations may be incrementally varied from layer-to-layer to produce a vertical lap joint. In either vertical step lap joint magnetic core structure, the equal length yoke laminations are incrementally shifted in a horizontal direction to form a step lap joint with the leg laminations. U.S. Pat. Nos. 3,670,279 and 3,918,153 both disclose arrangements for constructing a step lap joint with leg and yoke laminations that incrementally change lengths from layer to layer.

Another magnetic core structure of the stacked type is disclosed in U.S. Pat. No. 4,201,966. In that patent the outer legs, inner leg and top and bottom yokes are formed of a plurality of stacked groups of layers of metallic laminations. The length dimensions of the leg and yoke laminations are varied in opposite directions from layer to layer within each group of layers while maintaining the midpoints of the laminations in each leg and yoke portion in alignment. This arrangement offsets the ends of the leg and yoke laminations from layer to layer and provides a step lap joint between adjoining ends of the leg and yoke laminations. The relative locations of the leg and yoke laminations are selected to uniformly divide the voids formed at the inner corners of the magnetic core between the leg and yoke laminations within each group of layers of laminations.

While the foregoing magnetic core structure designs have been successful, they have left something to be desired. It would be desirable to provide a step lap side leg or limb design which is applicable to a three leg single phase core, a four leg single phase core and five leg single or three phase core. It would be desirable to provide a core that is easy to cut and build and where the parts and methods of assembly are less complex than the prior art. It would be desirable to have an arrangement where the inner or center core guides the step lap so that the step lap moves in the horizontal direction and all laminations of the core except the center leg laminations are identical within each group of laminations. Thus, the outer leg and yoke laminations are step independent. It would also be desirable to provide a magnetic core of the stacked type where the probability for consistently low core losses will be high due to the fact that the cores can be built with very tight tolerances.

SUMMARY OF THE INVENTION

In accordance with the present invention there is provided a magnetic core having a plurality of stacked groups of layers of metallic laminations, each of the groups including a plurality of layers. Each of the layers includes first and second outer leg laminations and at least one inner leg lamination, each having first and second ends, and top and bottom yoke laminations forming a magnetic core having the outer and inner leg laminations connected by the yoke laminations and a plurality of outer and associated inner corners. The yoke and leg laminations have there ends cut diagonally to provide a closed magnetic circuit having diagonal joints between adjoining ends of the yoke and leg laminations. The length dimensions of the inner leg laminations are uniform from layer to layer within each group, while the junction of the diagonally cut ends of the inner leg laminations are offset from the centerline thereof from layer to layer in a stepped pattern that progresses an equal number of steps on each side of the centerline of each group of layers of inner leg laminations to be step dependent. The configuration of the outer leg laminations and the top and bottom yoke laminations are uniform from layer to layer within each group to be step independent.

Further in accordance with the present invention there is provided a method of assembling a magnetic core of the above-described type. The method, for each layer of metallic laminations within a group, comprising the steps of placing a first inner leg lamination, placing a top yoke lamination in abutting relation thereto on one side of the center line thereof, placing an outer leg lamination in abutting relation to the top yoke lamination, placing a bottom yoke lamination in abutting relation to the outer and inner leg laminations, placing a bottom yoke lamination in abutting relation thereto on the other side of the center line thereof, placing an outer leg lamination in abutting relation with the last-named bottom yoke lamination, placing a top yoke lamination in abutting relation to the last-named outer leg lamination and the center leg lamination to complete the assembly of one layer of laminations in the core. The method further includes the steps of repeating the rotation of placement of the laminations in each layer until a group of stacked offset layers is completed, and repeating the rotation of placement of the laminations for each additional group to complete the stacking of the magnetic core.

BRIEF DESCRIPTION OF THE DRAWING

For a more detailed understanding of the invention, reference is made to the accompanied figures of the drawings in which.

DESCRIPTION OF THE PREFERRED EMBODIMENT

Figure 1:
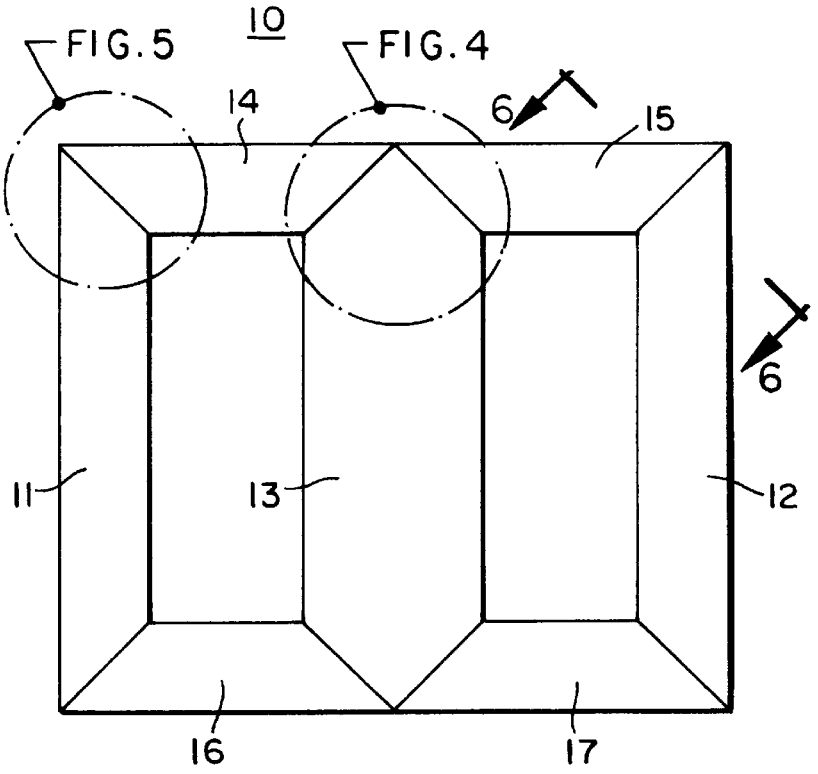
FIG. 1 is a front elevational view of a magnetic core illustrating one embodiment of the invention.
Figure 2:
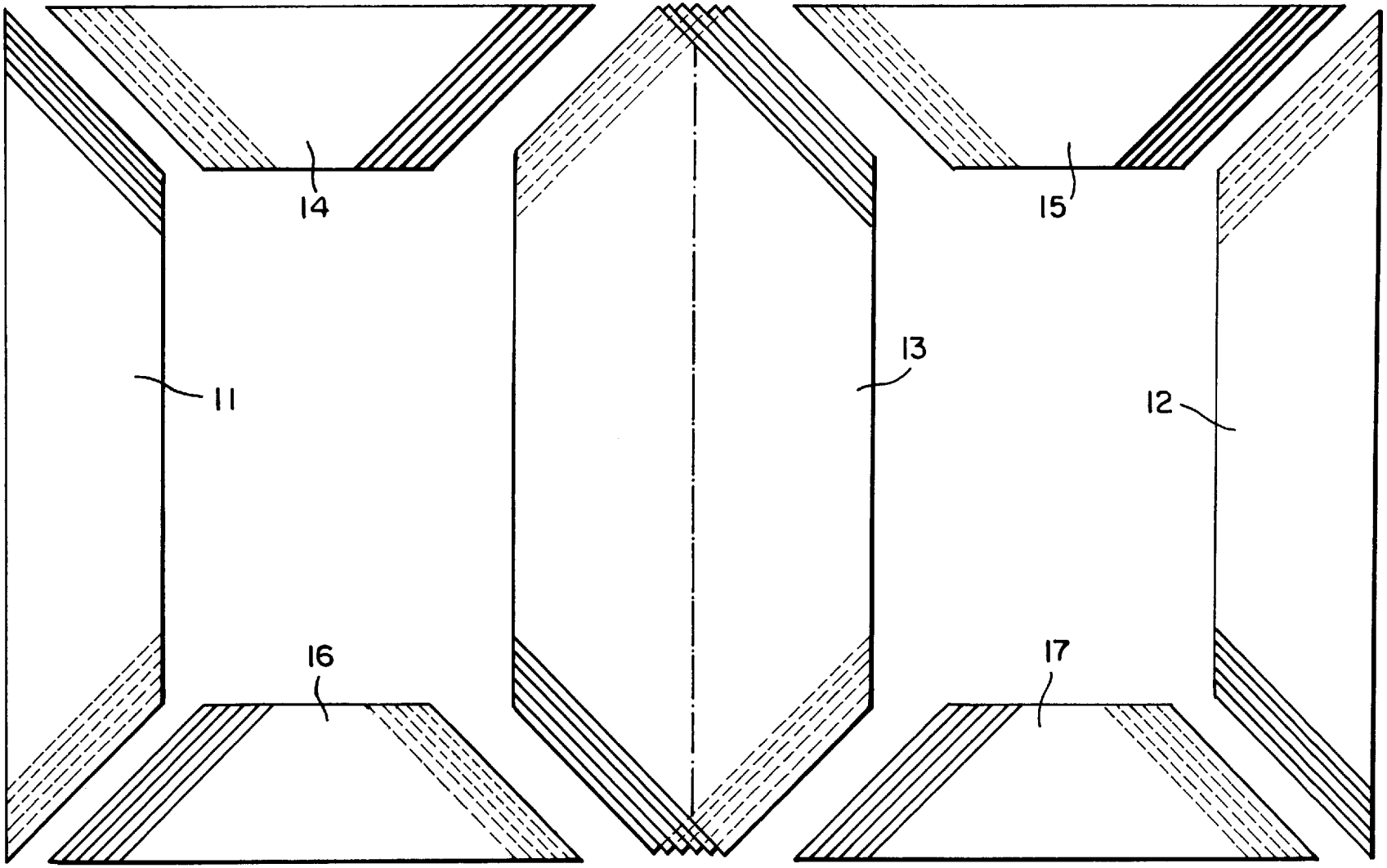
FIG. 2 is an exploded elevational view of a magnetic core structure constructed according to the embodiment illustrated in FIG. 1.

Referring to FIGS. 1 and 2 of the drawings there is illustrated a magnetic core structure 10 constructed according to the teachings of the present invention. The magnetic core 10 includes first and second outer leg portions 11 and 12 and an inner or center leg portion 13 and top and bottom yoke portions 14, 15, and 16, 17 respectively. The magnetic core 10 is of the stacked type, with each of the leg and yoke portions being constructed of a stack of metallic laminations formed of suitable magnetic material, such as grain-oriented silicon steel, which has predetermined width dimensions and a thickness dimension dependent upon the specific application. Each of the outer leg and yoke laminations has the same width dimension, each of the outer and inner leg laminations has the same length dimension and all of the yoke laminations have the same length dimensions. Each leg and yoke lamination is formed by a shearing operation which cuts the metallic strip diagonally at predetermined locations to provide leg and yoke laminations having a substantially trapezoid configuration, with the diagonally cut ends forming the non-parallel sides of the trapezoid and the edges of the strip forming the parallel sides of the trapezoid. The magnetic core 10 thus includes a plurality of layers of laminations with the ends of the leg and yoke laminations in each layer being butted together to provide a joint which presents the least resistance to magnetic flux.

It is to be understood that each layer of laminations in the magnetic core 10 is illustrated and described as comprising one lamination of magnetic material. However, it will be understood that the term "layer" is also meant to include a plurality of identically dimensioned superimposed laminations. Thus, for example, each layer illustrated in FIG. 2 may include two laminations which have identical length and width dimensions and are superimposed with their ends and edges in alignment.

The magnetic core 10 is formed of a plurality of groups of superimposed layers of metallic laminations, with each group, for example, including six layers of laminations. There is shown in FIG. 2 one group of laminations of the leg portions 11, 12 and 13 and the yoke portions 14, 15, 16 and 17 of the magnetic core 10.

Figure 3:
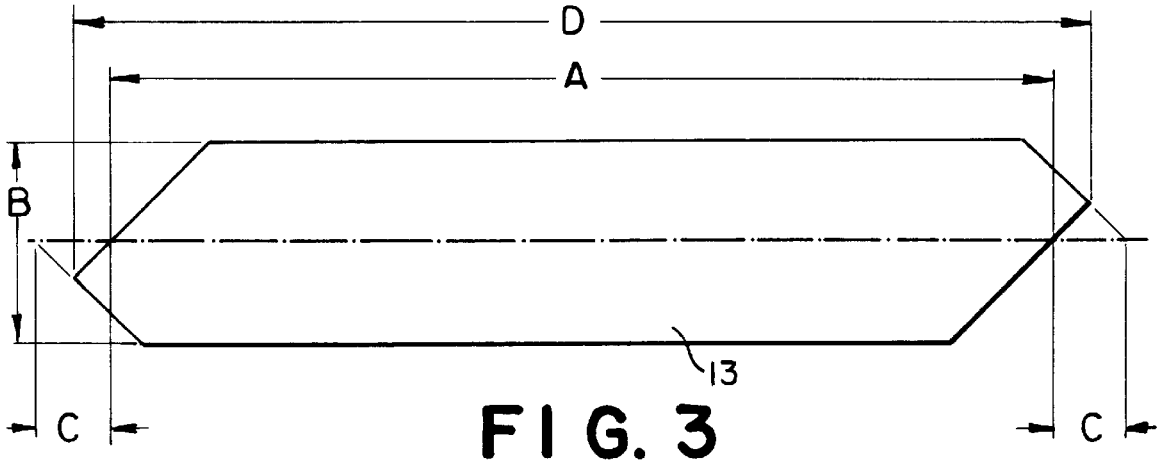
FIG. 3 illustrates an example of a center leg core lamination with dimensions that are step dependent.
Figure 4:
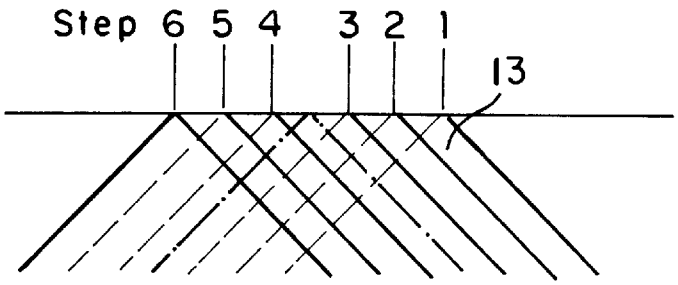
FIG. 4 is an explanatory drawing showing the steps in the center leg core laminations relating to the balloon in FIG. 1.
Figure 5:
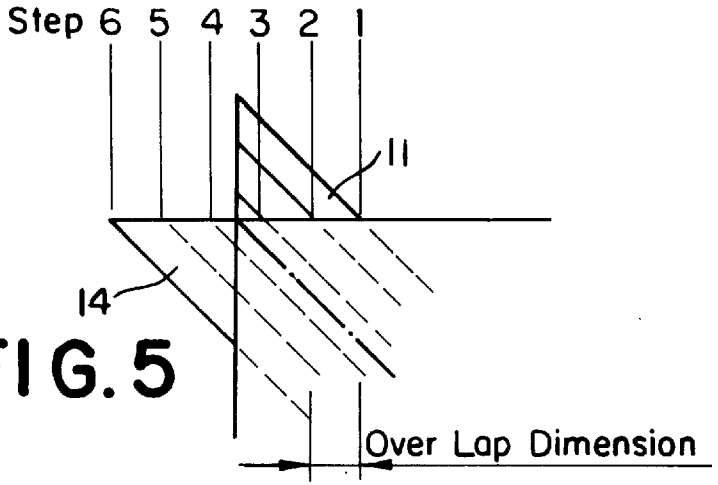
FIG. 5 is an explanatory drawing showing the corner lapping relating to the balloon in FIG. 1.

In accordance with the present invention, the core center limb or inner leg 13 guides the step lap. The center or inner leg laminations 13 are made according to FIG. 3 where B is the width dimension, D is the length dimension and the dimensions C and A are step dependent to create the full step lap (6 steps) shown in FIG. 4. The configuration of the remaining core laminations such as the outer leg laminations 11, 12 and yoke laminations 14–17 are uniform from layer to layer within each group and are step independent. By using a rotation pattern in stacking the core laminations a full step lap is created as illustrated in FIGS. 2 and 4. The rotation pattern or method for stacking the laminations in each layer starts with the center leg member 13 followed by yoke member 14, outer leg member 11, bottom yoke members 16 and 17, outer leg member 12 and finally top yoke member 15. A second layer of laminations is placed according to the rotation just described until all six layers of the group are positioned as illustrated in FIGS. 2 and 4. As may be seen in FIG. 2 the length dimensions of the inner leg laminations 13 are uniform from layer to layer within each group, while the junction of the diagonally cut ends of the inner leg laminations are offset from the center line thereof from layer to layer in a step pattern that progresses an equal number of steps on each side of the center line of each group of layers of inner leg laminations so as to be step dependent. It will also be seen from FIG. 2 that the configuration of the outer leg laminations 11 and 12 and the top yoke laminations 14, 15 and the bottom yoke laminations 16 and 17 are uniform from layer to layer within each group to be step independent. As may be seen in FIGS. 1 and 2 the yoke and leg laminations have their ends cut diagonally at a 45° angle to form a rectangular magnetic core. The ends of the inner leg laminations 13 are diagonally cut to be generally V-shaped and the junction of the diagonally cut ends form an included angle of 90°. Because of the step lap construction, the laminations of the outer leg and yoke at the corners of the rectangular core 10 overlap in the manner illustrated on enlarged scale in FIG. 5.

Figure 6:
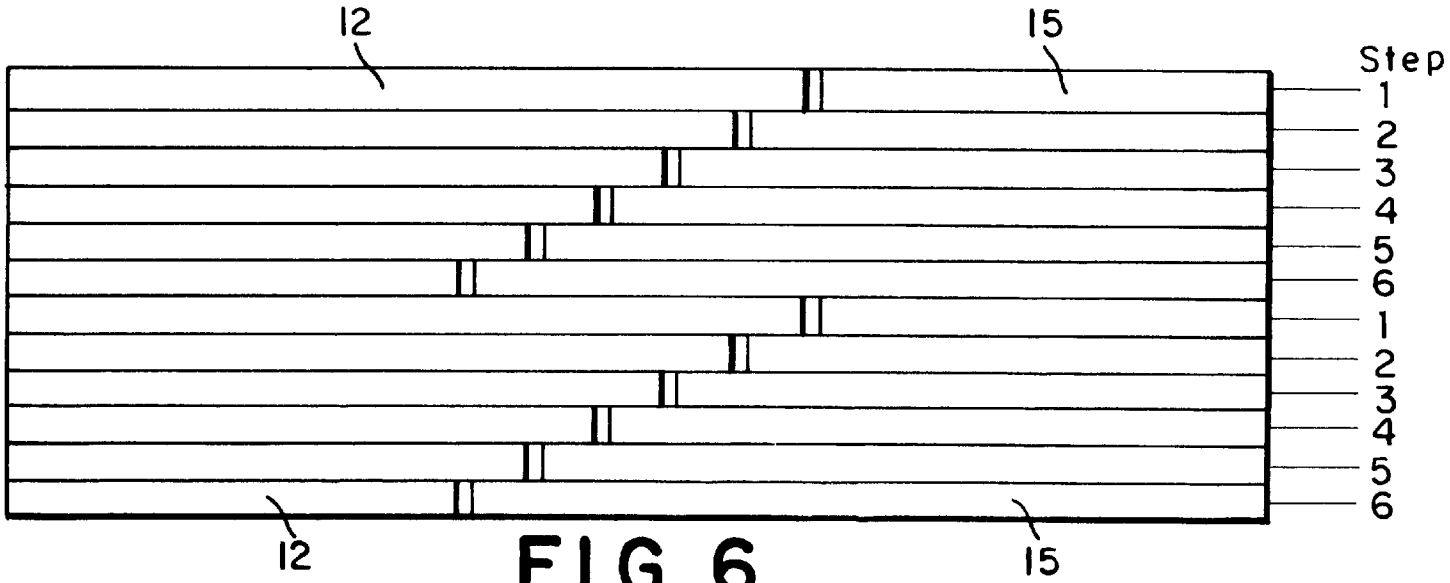
FIG. 6 is a sectional view taken along the line 6—6 in FIG. 1.

While FIG. 2 illustrates one group of laminations including six layers of laminations, it will be understood that a magnetic core such as core 10 will include several groups of laminations. In FIG. 6 there is illustrated a sectional view through the corner of the core 10 shown in FIG. 1 where two groups of laminations of the step lap design are illustrated, each group including six laminations. It will be noted in FIG. 6 that the six steps are repeated in each group.

Figure 7:
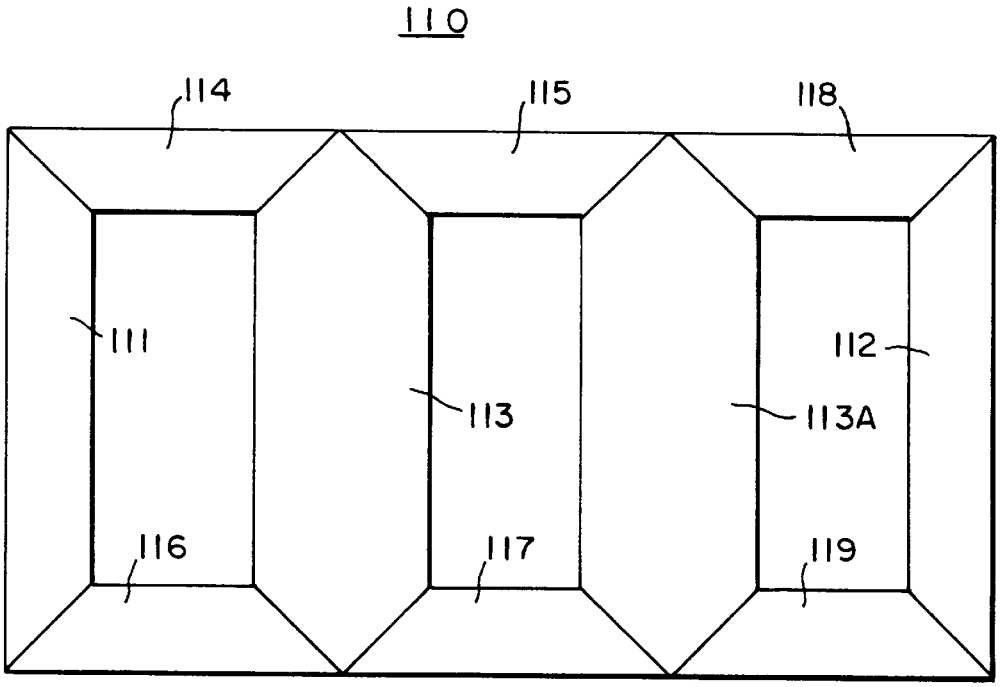
FIG. 7 is an elevational view of another embodiment of a magnetic core structure constructed according to the present invention.
Figure 7A:
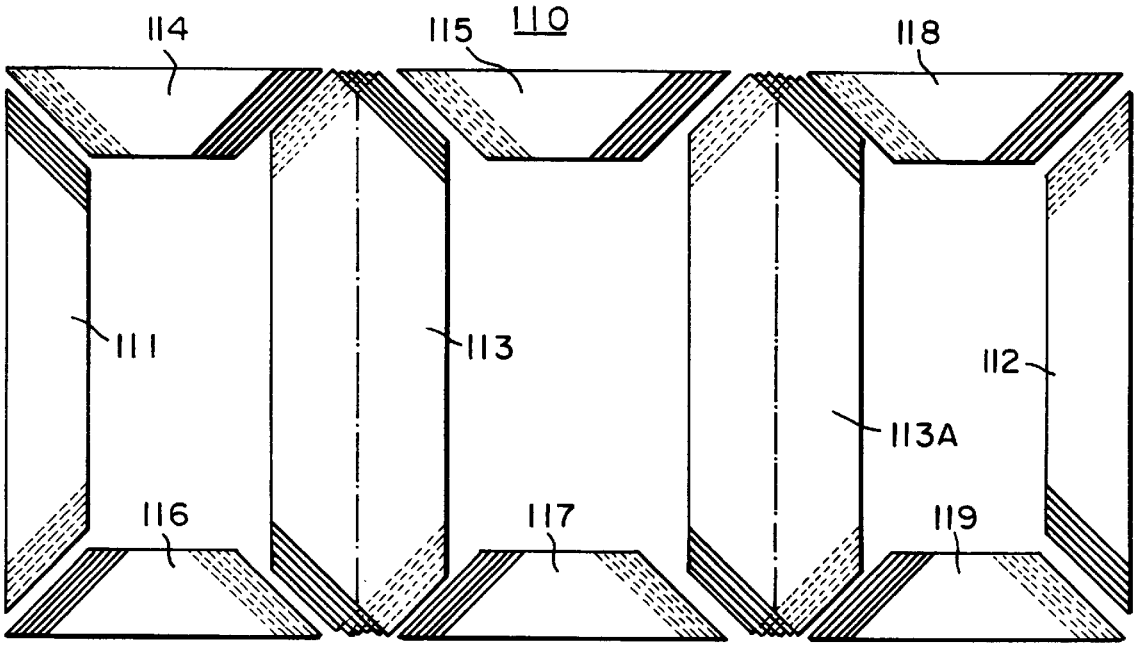
FIG. 7A is an exploded elevational view of a magnetic core structure constructed according to the embodiment illustrated in FIG. 7.

Referring to FIGS. 7 and 7A there is illustrated another embodiment of a magnetic core structure 110 constructed according to the teachings of the present invention. The magnetic core structure 110 is similar to the magnetic core structure 10 except it includes two inner or center leg portions. The magnetic core structure 110 includes first and second outer leg portions 111 and 112 and two inner or center leg portions 113 and 113A. It also includes three top yoke portions 114, 115 and 118 and three bottom yoke portions 116, 117 and 119.

The magnetic core 110 is formed of a plurality of groups of superimposed layers of metallic laminations, with each group, for example, including six layers of laminations. There is shown in FIG. 7A one group of laminations of the leg portions, 111, 112, 113 and 113A and the yoke portions 114, 115, 116, 117, 118 and 119 of the magnetic core 110.

In accordance with the present invention the core center or inner legs 113 and 113A guide the step lap. The center or inner leg laminations 113 and 113A are made according to FIG. 3 as previously described in connection with the magnetic core 10 where the dimensions C and A are step dependent. The remaining core lamination such as the outer leg laminations 111 and, 112 and the yoke laminations 114, 115, 116, 117, 118, and 119 are step independent. By using a rotation pattern and stacking the core laminations, a full step lap is created as illustrated in FIG. 4. The rotation pattern or method for stacking the laminations in each layer starts with the center leg member 113 followed by yoke member 114, outer leg member 111, bottom yoke members 116 and 117, innerleg 113A, bottom yoke member 119, outer leg member 112 and finally top yoke members 118 and 115. A second layer of laminations is placed according to the rotation just described until all six layers of the group are positioned as illustrated in FIGS. 7A and 4. As may be seen in FIG. 7A, the length dimensions of the inner leg laminations 113 and 113A are uniform from layer to layer within each group, while the junction of the diagonally cut ends of the inner leg laminations are offset from the center line thereof from layer to layer in a step pattern that progresses an equal number of steps on each side of the center line of each group of layers of inner leg laminations so as to be step dependent. It will also be seen from FIG. 7A that the configuration of the outer leg laminations 111 and 112 and the top yoke laminations 114, 115 and 118 and the bottom yoke laminations 116, 117 and 119 are uniform from layer to layer within each group to be step independent. The laminations of the outer leg and yoke at the corners of the rectangular core 110 overlap in the same manner as illustrated on enlarged scale in FIG. 5. When the magnetic core 110 includes two or more groups of laminations, a sectional view through the corner of the core 110 will be similar to the sectional view shown in FIG. 6.

Figure 8:
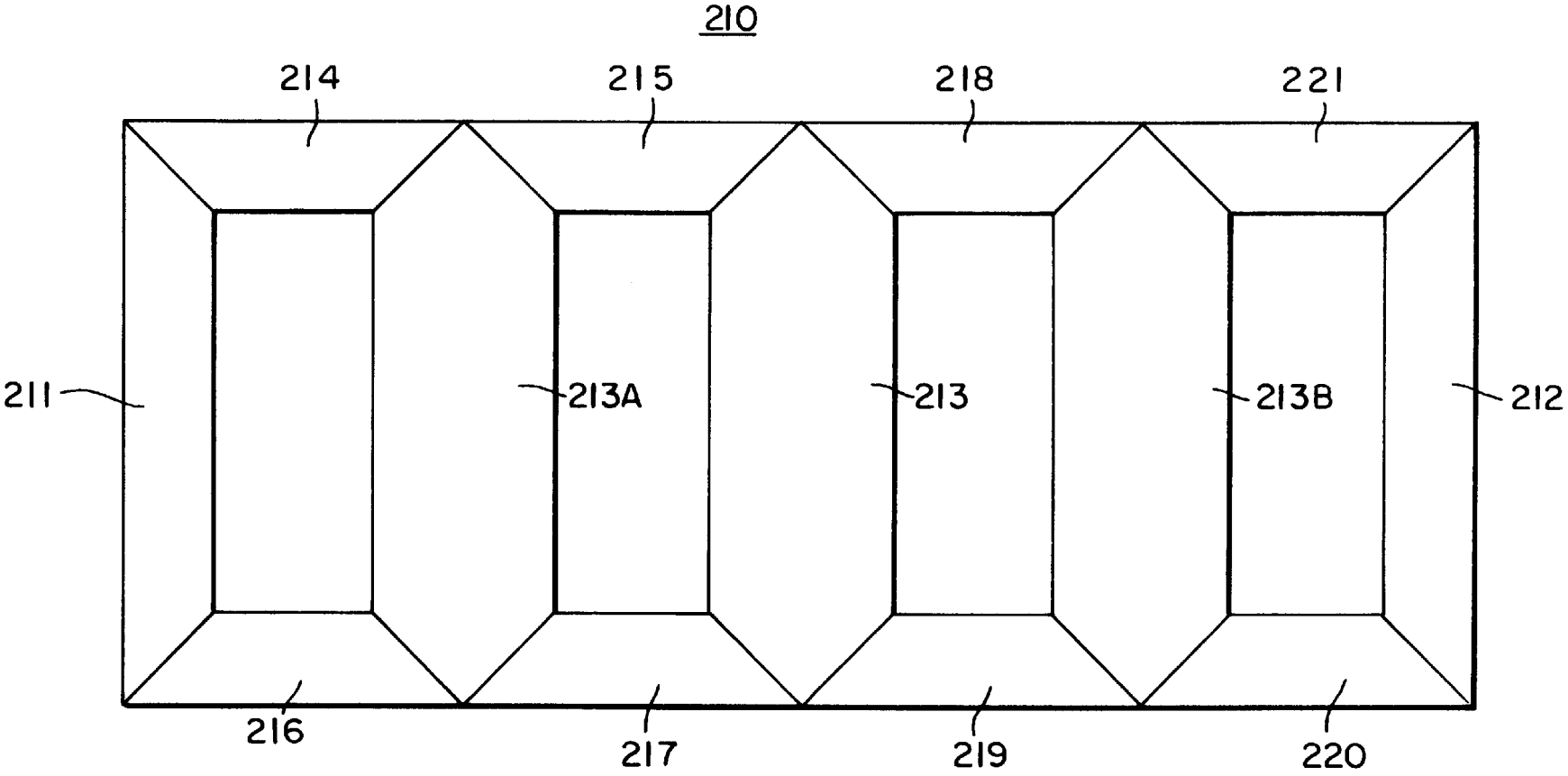
FIG. 8 is an elevational view of another magnetic core structure constructed in accordance with the present invention.
Figure 8A:
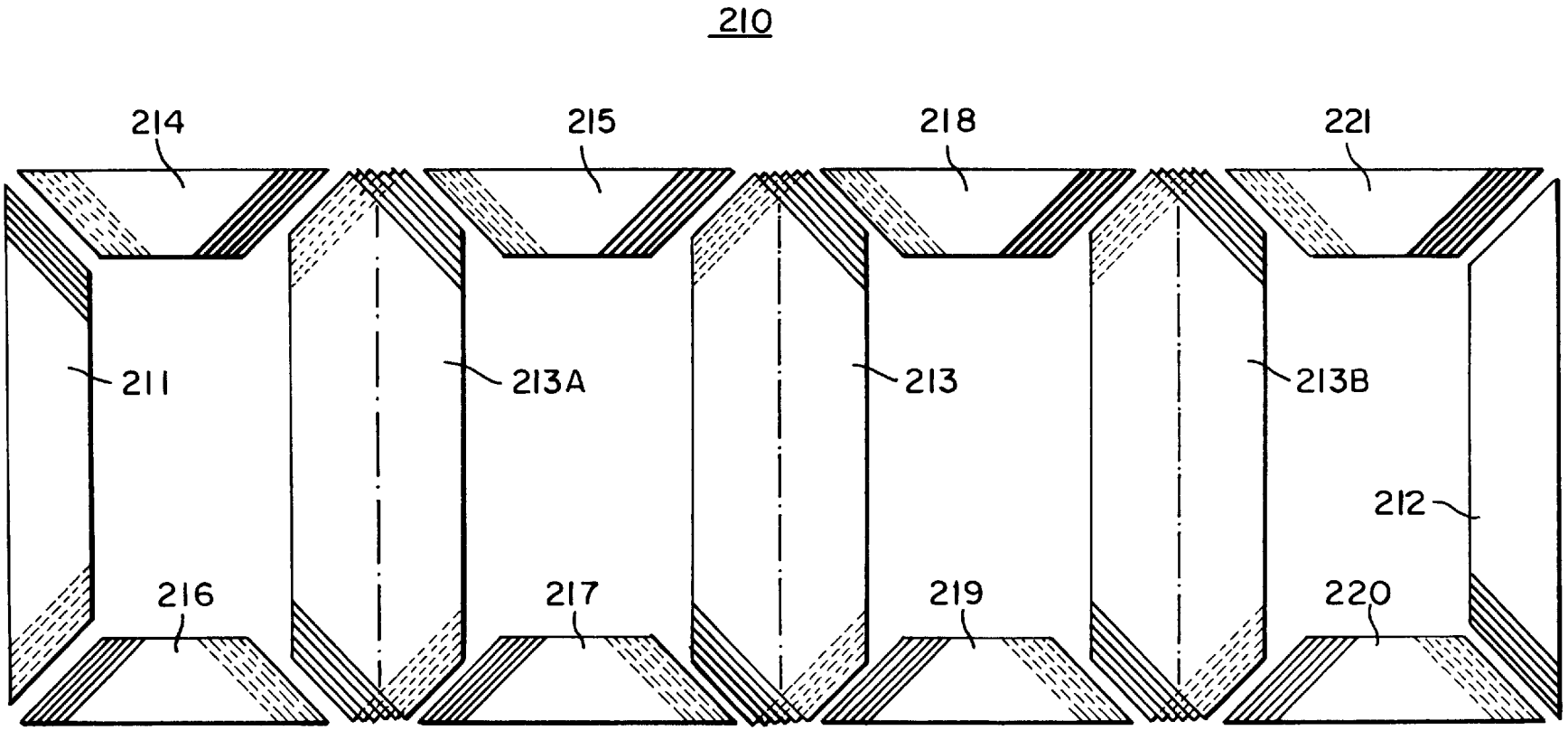
FIG. 8A is an exploded elevational view of a magnetic core structure constructed according to the embodiment illustrated in of FIG. 8.

Referring to FIGS. 8 and 8A there is illustrated another embodiment of a magnetic core structure 210 constructed according to the teachings of the present invention. The magnetic core structure 210 is similar to the previously described magnetic core structures 10 and 110 except it includes three inner or center leg portions. The magnetic core structure 210 includes first and second outer leg portions 211 and 212 and three inner or center leg portions 213, 213A and 213B. It also includes four top yoke portions 214, 215, 218 and 221 and four bottom yoke portions 216, 217, 219 and 220.

The magnetic core 210 is formed of a plurality of groups of superimposed layers of metallic laminations, with each group, for example, including six layers of laminations. There is shown in FIG. 8A one group of laminations of the leg portions 211, 212, 213, 213A and 213B and the yoke portions 214, 215, 216, 217, 218, 219, 220 and 221 of the magnetic core 210.

In accordance with the present invention the core center or inner legs 213, 213A and 213B are made according to FIG. 3 as previously described in connection with the magnetic core 10 where the dimensions C and A are step dependent. The remaining core laminations such as the outer leg laminations 211 and 212 and the yoke laminations 214, 215, 216, 217, 218, 219, 220 and 221 are step independent. By using a rotation pattern and stacking the core laminations, a full six step lap is created as illustrated in FIG. 4. The rotation pattern or method for stacking the laminations in each layer starts with the center leg member 213 followed by yoke member 215, inner leg member 231A, yoke member 214, outer leg member 211, yoke member 216, yoke member 217, yoke member 219, inner leg member 213B, yoke member 220, outer leg member 212, yoke member 221 and yoke member 218. A second layer of laminations is placed according to the rotation described until all six layers of the group are positioned as illustrated in FIGS. 8A and 4. As may be seen in FIG. 8A, the length dimensions of the inner leg laminations, 213, 213A and 213B are uniform from layer to layer within each group, while the junction of the diagonally cut ends of the inner leg laminations are offset from the center line thereof from layer to layer in a step pattern that progresses an equal number of steps on each side of the center line of each group of layers of inner leg laminations so as to be step dependent. It will also be seen that from FIG. 8A that the configuration of the outer leg laminations 211 and 212 and the top yoke laminations 214, 215, 218 and 221 and the bottom yoke laminations 216, 217, 219 and 220 are uniform from layer to layer within each group to be step independent. The laminations of the outer leg and yoke at the corners of the rectangular core 210 overlap in the same manner as illustrated on enlarged scale in FIG. 5. When the magnetic core 210 includes two or more groups of laminations, a sectional view through the corner of the core 210 will be similar to the sectional view shown in FIG. 6.

Figure 9:
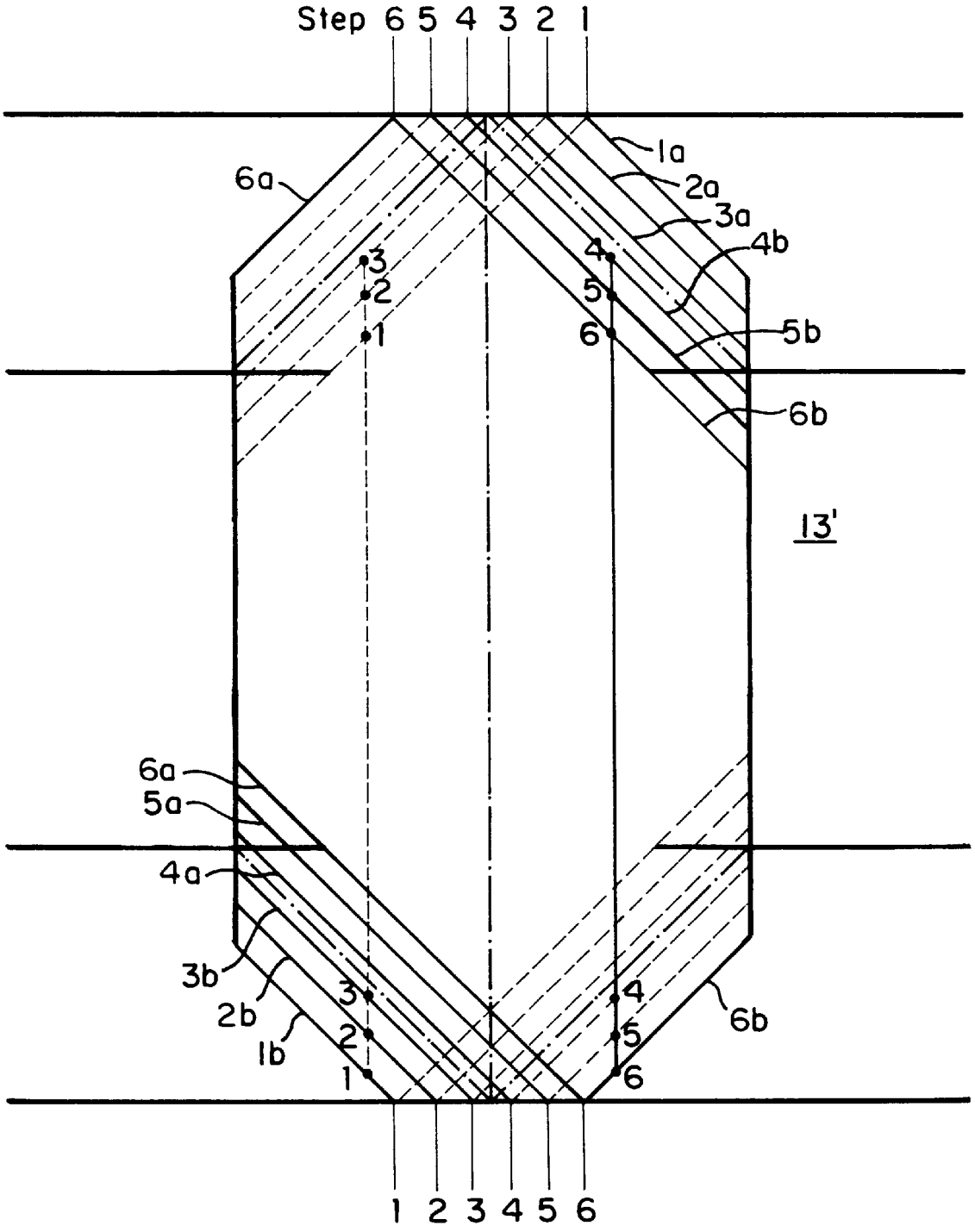
FIG. 9 is an explanatory view of a divided center leg for a magnetic core made according to the present invention.

In the embodiments illustrating magnetic cores 10, 110, and 210 the center or inner leg laminations 13, 113, 113A, 213, 213A, 213B have been illustrated as being made of solid or single width magnetic material. It is customary to be able to obtain sheet widths of magnetic material up to 1,000 mm. Where wider sheets or laminations are required, it is preferable to make the laminations divided or in two pieces a and b. A center leg 13' of divided construction is illustrated in explanatory FIG. 9 which includes construction lines for clarity in illustration. As shown in Fig. 9 for steps 1 to 3 the longitudinal joint between the center leg sheets 1*a*, 1*b*, 2*a*, 2*b*, 3*a*, 3*b* is made on the left side of the center leg of the center line and for steps 4 to 6 the longitudinal joint between the center leg sheets 4*a*, 4*b*, 5*a*, 5*b*, 6*a*, 6*b* is made on the right side of the center line of the center leg. By joining the center leg sheets in the above described manner, this will increase the leg stiffness and should have a positive impact on sound level. The divided center leg or limb construction 13' of FIG. 9 is applicable to all three of the magnetic cores 10, 110 and 210 where the width of the center leg laminations exceed the normally available commercial sheet widths i.e. 1,000 mm. Thus it will be seen that where wider sheets of magnetic material are required in the magnetic cores 10,

110 and 210 the inner legs 13, 113, 113A, 213, 213A, 213B would be made according to the divided construction 13' illustrated in FIG. 9.

Although the step lap pattern illustrated in the drawings consists of six layers, as many steps on each side of the center may be utilized as required. It has been found that better results are obtained, from a standpoint of efficiency and noise, when at least six steps of layers of laminations are utilized. The step increments may vary depending upon the size of the magnetic core. Smaller magnetic cores may utilize a step increment of ⅛ ", while the larger cores may utilize a step increment as great as ¼ " while intermediate size magnetic cores may use a step increment of 3⁄16 ".

In summary, there has been disclosed herein a new and improved magnetic structure of the stacked type. The magnetic core structure has step lap joints between adjoining leg an yoke portions where the design of the center core limb guides the step lap and the dimensions of the center core limb are step dependent. The length dimensions of the center or inner leg laminations are uniform from layer to layer within each group while the junction of the diagonally cut ends of the inner leg laminations are offset from the center line thereof from layer to layer in a step pattern that progresses an equal number of steps on each side of the center line of each group of layers of inner leg laminations so as to be step dependent. The configuration of the outer leg laminations and the top and bottom yoke laminations are uniform from layer to layer within each group to be step independent.

What is claimed is:

1. A magnetic core comprising:

a plurality of stacked groups of layers of metallic laminations, each of said groups including a plurality of layers;

each of said layers including first and second outer leg laminations and at least one inner leg lamination, each having first and second ends, and top and bottom yoke laminations forming a magnetic core having said outer and inner leg laminations connected by said yoke laminations and a plurality of outer and associated inner corners;

said yoke and said leg laminations having their ends cut diagonally to provide a closed magnetic circuit having diagonal joints between adjoining ends of said yoke and leg laminations;

the length dimensions of the inner leg laminations being uniform from layer to layer within each group, while the junction of the diagonally cut ends of the inner leg laminations are off-set from the centerline thereof from layer to layer in a stepped pattern that progresses an equal number of steps on each side of the centerline of each group of layers of inner leg laminations to be step dependent; said inner leg laminations having a width of at least 1000 mm and being constructed of two parts divided longitudinally to form a joint along a line parallel to one side of the centerline of the lamination, and alternate layers of laminations have the longitudinal joint on different sides of the centerline of the inner leg laminations;

and the configuration of the outer leg laminations and the top and the bottom yoke laminations are uniform from layer to layer within each group to be step independent.

2. A magnetic core according to claim 1 wherein each layer of metallic laminations includes at least two inner leg laminations and at least three top and three bottom yoke laminations.

3. A magnetic core according to claim 1 wherein each layer of metallic laminations includes at least three inner leg laminations and at least four top and four bottom laminations.

4. A magnetic core according to claim 1 wherein said yoke and said leg laminations have their ends cut diagonally at a 45° angle to form a rectangular magnetic core.

5. A magnetic core according to claim 4 wherein the ends of said inner leg laminations are diagonally cut to be generally V-shaped and said junction of the diagonally cut ends form an included angle of 90°.

6. A magnetic core according to claim 1 wherein each group of layers includes at least six layers of laminations.

7. A magnetic core according to claim 6 wherein said stepped pattern progresses at least three steps on each side of the centerline of each group of layers of inner leg laminations.

8. A magnetic core according to claim 1 wherein in each group of inner leg laminations one half of the inner leg laminations have the longitudinal joint on one side of the centerline of the group and the second half of the center leg laminations have the longitudinal joint on the opposite side of the centerline of the group of laminations.

9. A method of assembling a magnetic core having:

a plurality of stacked groups of layers of metallic laminations, each of said groups including a plurality of layers;

each of said layers including first and second outer leg laminations and at least one inner leg lamination, each having first and second ends, and top and bottom yoke laminations forming a magnetic core having said outer and inner leg laminations connected by said yoke laminations and a plurality of outer and associated inner corners;

said yoke and said leg laminations having their ends cut diagonally to provide a closed magnetic circuit having diagonal joints between adjoining ends of said yoke and leg laminations;

the length dimensions of the inner leg laminations being uniform from layer to layer within each group, while the junction of the diagonally cut ends of the inner leg laminations are off-set from the centerline thereof from layer to layer in a stepped pattern that progresses an equal number of steps on each side of the centerline of each group of layers of inner leg laminations to be step dependent; wherein each said inner leg lamination has a width of at least 1000 mm and is constructed of two parts divided longitudinally to form a joint along a line parallel to one side of the center line of the lamination, and alternate layers of laminations have the longitudinal joint on different sides of the center line of the inner leg laminations; and the configuration of the outer leg laminations and the top and the bottom yoke laminations are uniform from layer to layer within each group to be step independent;

said method, for each layer of metallic laminations within a group, comprising the steps of placing a first inner leg lamination, placing a top yoke lamination in abutting relation thereto on one side of the centerline thereof, placing an outer leg lamination in abutting relation to the top yoke lamination, placing a bottom yoke lamination in abutting relation to the outer and inner leg laminations, placing a bottom yoke lamination in abutting relation thereto on the other side of the centerline thereof, placing an outer leg lamination in abutting relation with said last-named bottom yoke lamination, placing a top yoke lamination in abutting relation to said last-named outer leg lamination and said center leg lamination to complete the assembly of one layer of laminations in said core, repeating the rotation of placement of the laminations in each layer until a group of stacked offset layers is completed, and repeating the rotation of placement of the laminations for each additional group to complete the stacking of the magnetic core.

10. A method of assembling a magnetic core according to claim 9 wherein in each group of inner leg laminations one half of the inner leg laminations have the longitudinal joint on one side of the centerline of the group and the second half of the center leg laminations have the longitudinal joint on the opposite side of the centerline of the group of laminations.

* * * * *